US010890154B2

(12) United States Patent
Morimoto et al.

(10) Patent No.: US 10,890,154 B2
(45) Date of Patent: Jan. 12, 2021

(54) ELECTROMAGNETIC SWITCH DEVICE FOR STARTER

(71) Applicant: Mitsubishi Electric Corporation, Tokyo (JP)

(72) Inventors: Yoshihiro Morimoto, Tokyo (JP); Takuma Ono, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 210 days.

(21) Appl. No.: 16/070,715

(22) PCT Filed: Apr. 26, 2016

(86) PCT No.: PCT/JP2016/062966
§ 371 (c)(1),
(2) Date: Jul. 17, 2018

(87) PCT Pub. No.: WO2017/187493
PCT Pub. Date: Nov. 2, 2017

(65) Prior Publication Data

US 2019/0017485 A1 Jan. 17, 2019

(51) Int. Cl.
*H01H 3/00* (2006.01)
*F02N 11/08* (2006.01)
(Continued)

(52) U.S. Cl.
CPC ..... *F02N 11/087* (2013.01); *H01H 50/023* (2013.01); *H01H 50/026* (2013.01);
(Continued)

(58) Field of Classification Search
CPC ..... H01H 51/06; H01H 51/065; H01H 50/44; H01H 50/54; H01H 50/543; H01H 50/443;
(Continued)

(56) References Cited

U.S. PATENT DOCUMENTS 3,815,060 A * 6/1974 Turnbull ..... H01H 51/005 335/133
4,203,084 A * 5/1980 Yamaguchi ..... H01H 51/065 200/306
(Continued)

FOREIGN PATENT DOCUMENTS

JP 3998730 B2 10/2007

OTHER PUBLICATIONS

International Search Report of PCT/JP2016/062966 dated Jul. 19, 2016 [PCT/ISA/210].

*Primary Examiner* — Shawki S Ismail
*Assistant Examiner* — Lisa N Homza
(74) *Attorney, Agent, or Firm* — Sughrue Mion, PLLC; Richard Turner

(57) ABSTRACT

The electromagnetic switch device for a starter includes: an A connector which forms a starting circuit, which is connected to a starting resistor, and which has an end at which one of a pair of starting circuit contacts is located; a B connector which forms the starting circuit, which is connected to one of a pair of main fixed contacts, and which has an end at which the other of the pair of starting circuit contacts is located; an insulating member electrically insulating the A connector and the B connector from a main fixed core; and an elastic member sealing a contact chamber, wherein the A connector and the B connector are held between a terminal block and the main fixed core with the insulating member and the elastic member interposed therebetween.

20 Claims, 8 Drawing Sheets

(51) Int. Cl.

| | |
|---|---|
| ***H01H 51/06*** | (2006.01) |
| ***H01H 50/02*** | (2006.01) |
| ***H01H 50/54*** | (2006.01) |
| ***H01H 50/14*** | (2006.01) |
| ***H01H 50/44*** | (2006.01) |
| *H01H 50/04* | (2006.01) |

(52) U.S. Cl.
CPC ..... *H01H 50/14* (2013.01); *H01H 50/44* (2013.01); *H01H 50/54* (2013.01); *H01H 50/546* (2013.01); *H01H 51/065* (2013.01); *H01H 50/443* (2013.01); *H01H 50/543* (2013.01); *H01H 2050/049* (2013.01)

(58) Field of Classification Search
CPC ..... H01H 50/14; H01H 50/02; H01H 50/42; H01H 47/22; H01R 9/24; F02N 11/08
USPC ..... 335/185
See application file for complete search history.

(56) References Cited

U.S. PATENT DOCUMENTS 4,604,597 A * 8/1986 Bogner ..... H01H 51/065 335/127
4,755,781 A * 7/1988 Bogner ..... H01H 51/065 335/126
5,181,002 A * 1/1993 Sugiyama ..... H01H 51/065 335/131
5,214,401 A * 5/1993 Kimura ..... H01H 1/16 335/126
5,227,751 A * 7/1993 Shiroyama ..... F02N 15/066 335/126
5,245,304 A * 9/1993 Zenmei ..... H01H 51/065 335/126
5,631,613 A * 5/1997 Niimi ..... H01H 51/065 335/126
6,360,707 B1 3/2002 Boegner
7,116,196 B1 * 10/2006 Hirabayashi ..... H01H 50/443 335/282
7,549,899 B2 * 6/2009 Imanishi ..... H01H 50/443 335/126
8,143,979 B2 * 3/2012 Usami ..... H01R 4/06 335/127
8,193,882 B2 * 6/2012 Murata ..... F02N 15/067 335/126
8,847,713 B2 * 9/2014 Niimi ..... F02N 11/087 335/126
2002/0145494 A1 * 10/2002 Andoh ..... H01H 51/065 335/126
2004/0012902 A1 * 1/2004 Ikeda ..... F02N 11/087 361/23
2004/0032309 A1 * 2/2004 Kajino ..... F02N 11/087 335/126
2004/0168666 A1 * 9/2004 Nagai ..... F02N 11/0851 123/179.25
2004/0178870 A1 * 9/2004 Ohmi ..... F02N 15/067 335/126
2005/0093665 A1 * 5/2005 Imanishi ..... H01H 51/065 335/220
2006/0109070 A1 * 5/2006 Hirabayashi ..... H01H 51/065 335/126
2006/0132268 A1 * 6/2006 Hirabayashi ..... H01H 50/14 335/126
2006/0135002 A1 * 6/2006 Imanishi ..... H01R 4/36 439/793
2007/0069840 A1 * 3/2007 Masaki ..... H01H 50/30 335/126
2007/0120632 A1 * 5/2007 Tsukada ..... H01H 51/065 335/220
2007/0139146 A1 * 6/2007 Kusumoto ..... F02N 15/10 335/131
2007/0194868 A1 * 8/2007 Kurasawa ..... H01H 51/065 335/132
2007/0284234 A1 * 12/2007 Kurasawa ..... H01H 51/065 200/400
2008/0136568 A1 * 6/2008 Miyake ..... H01H 50/14 335/202
2010/0102905 A1 * 4/2010 Yamauchi ..... F02N 11/087 335/185
2010/0134224 A1 * 6/2010 Choi ..... H01H 50/045 335/132
2010/0237968 A1 * 9/2010 Kurasawa ..... H01H 51/065 335/156
2010/0251852 A1 * 10/2010 Murata ..... F02N 11/087 74/7 A
2010/0264764 A1 * 10/2010 Usami ..... F02N 15/067 310/71
2010/0264765 A1 * 10/2010 Haruno ..... F02N 11/087 310/71
2010/0271155 A1 * 10/2010 Kaneda ..... H01H 51/065 335/126
2011/0095545 A1 * 4/2011 Nakayama ..... F02N 15/00 290/38 R
2011/0187127 A1 * 8/2011 Murata ..... F02N 15/067 290/380
2011/0248803 A1 * 10/2011 Niimi ..... F02N 11/087 335/202
2011/0279202 A1 * 11/2011 Ramezanian ..... F02N 11/087 335/196
2011/0304947 A1 * 12/2011 Niimi ..... H01H 36/00 361/206
2012/0019340 A1 * 1/2012 Ramezanian ..... H01H 51/065 335/2
2012/0162847 A1 * 6/2012 Suzuki ..... F02N 15/067 361/206
2012/0180745 A1 * 7/2012 Biessenberger ..... H01H 51/065 123/179.25
2014/0109856 A1 * 4/2014 Kimura ..... F02N 15/067 123/179.28
2014/0167892 A1 * 6/2014 Hirabayashi ..... H01H 51/065 335/203
2014/0176267 A1 * 6/2014 Hirabayashi ..... H01H 50/12 335/127
2014/0311434 A1 * 10/2014 Hirabayashi ..... F02N 11/087 123/179.25
2014/0311436 A1 * 10/2014 Hirabayashi ..... H01H 51/065 123/179.25
2015/0285203 A1 * 10/2015 Hirabayashi ..... F02N 15/02 123/179.25
2015/0371800 A1 * 12/2015 Naumann ..... H01H 47/04 335/185
2016/0155590 A1 * 6/2016 Suzuki ..... H01H 47/22 361/160
2017/0175696 A1 * 6/2017 Florijancic ..... F02N 11/087
2018/0003141 A1 * 1/2018 Morimoto ..... F02N 11/0851
2018/0005790 A1 * 1/2018 Morimoto ..... H01H 50/14
2018/0119663 A1 * 5/2018 Radhakrishnan ... F02N 11/0855
2018/0347536 A1 * 12/2018 Florijancic ..... F02N 11/087
2019/0017485 A1 * 1/2019 Morimoto ..... H01H 50/14
2019/0048840 A1 * 2/2019 Ono ..... F02N 11/08
2019/0219017 A1 * 7/2019 Ono ..... H01H 50/443
2020/0075279 A1 * 3/2020 Manfreda ..... H01H 50/42
2020/0075280 A1 * 3/2020 Manfreda ..... H01H 50/44

* cited by examiner

ELECTROMAGNETIC SWITCH DEVICE FOR STARTER

CROSS REFERENCE TO RELATED APPLICATIONS

This application is a National Stage of International Application No. PCT/JP2016/062966, filed Apr. 26, 2016.

TECHNICAL FIELD

The present invention relates to an electromagnetic switch device for a starter, used for a starter for starting an engine provided to an automobile, for example.

BACKGROUND ART

An electromagnetic switch device for a starter has a function to mesh a pinion of a starter with a ring gear and a function to open and close a motor main electric circuit.

The electromagnetic switch device for a starter includes an attraction coil and a holding coil in order to achieve these two functions. One end of the attraction coil is connected to the motor main electric circuit.

Due to such connection, a current can be conducted to the attraction coil only in a short time that is during pinion meshing operation or during motor main electric circuit closing operation, which are the above functions.

As a result, rise in the temperature of the attraction coil is small, and thus the attraction coil can be formed from even a material having low heat resistance with respect to the conduction current.

In the electromagnetic switch device for a starter configured as described above, the magnitude and temporal change of a current flowing through the attraction coil mutually affect the above two functions, the timing at which a motor starts to rotate, and the angular velocity of the motor.

Due to the mutual effect, it is difficult to bring each of these four functions into the best condition in the design of the attraction coil and the holding coil.

An electromagnetic switch device for a starter is known in which, to solve this, the attraction coil is changed to a starting circuit and the holding coil is changed to an attraction coil having an attracting and holding function (for example, Patent Document 1).

The starting circuit includes a starting resistor and a starting circuit contact.

CITATION LIST

Patent Document

Patent Document 1: Japanese Patent No. 3998730

SUMMARY OF THE INVENTION

Problems to be Solved by the Invention

However, in the embodiment of Patent Document 1 described above, the starting circuit contact is present in the same space (contact chamber) as a contact of a motor main circuit, and is close to a body-grounded main fixed core. In addition, the main fixed core and a screw for fixing the starting circuit contact are also close to each other.

As a result, there is a disadvantage in that by contact abrasion powder produced a main fixed contact, a main movable contact, and the starting circuit contact, a leak path is created between the starting circuit contact and the main fixed core, so that a leak current flows therethrough.

The present invention has been made to solve the above problem, and an object of the present invention is to provide an electromagnetic switch device for a starter in which a starting circuit is provided but a leak current due to contact abrasion powder is prevented.

Solution to the Problems

An electromagnetic switch device for a starter according to the present invention includes: a pair of main fixed contacts forming a main electric circuit for a motor; a pair of starting circuit contacts forming a starting circuit for the motor; a main movable contact which is movably located between the pair of main fixed contacts and the pair of starting circuit contacts, which opens and closes the main electric circuit for the motor by opening and closing the pair of main fixed contacts, and which opens and closes the starting circuit for the motor by opening and closing the pair of starting circuit contacts; a starting resistor which forms the starting circuit and through which a starting current for the motor flows; an attraction coil generating a magnetic field for moving the main movable core toward the pair of main fixed contacts; a main fixed core forming a magnetic circuit for generating magnetic force by the magnetic field of the attraction coil; a terminal block to which the main fixed contacts are fixed and which includes a contact chamber that is a space in which the movable contact is movable; an A connector which forms the starting resistor circuit, which is connected to the starting resistor, and which has an end at which one of the pair of starting circuit contacts is located; a B connector which forms the starting resistor circuit, which is connected to one of the pair of main fixed contacts, and which has an end at which one of the pair of starting circuit contacts is located; an insulating member electrically insulating the A connector and the B connector from the fixed core; and an elastic member sealing the contact chamber, wherein the A connector and the B connector are held between the terminal block and the fixed core with the insulating member and the elastic member interposed therebetween.

Effect of the Invention

In the electromagnetic switch device for a starter according to the present invention, since the A connector and the B connector are held between the terminal block and the main fixed core with the insulating member and the elastic member interposed therebetween, it is not necessary to use conductive members such as screws in order to fix the pair of starting circuit contacts.

In addition, the contact chamber is partitioned into the main fixed contact side and the main fixed core side by the A connector, the B connector, the starting circuit contacts, and the insulating member. Accordingly, abrasion powder produced from the main movable contact, the pair of main fixed contacts, and the pair of starting circuit contacts does not electrically contact with the main fixed core which is a ground circuit.

Therefore, a leak path does not occur between the pair of starting circuit contacts, the A connector, and the B connector to which a voltage is applied at the time of operation of the electromagnetic switch device for a starter, and the main fixed core, which is a ground circuit, so that, a leak current does not flow.

DESCRIPTION OF EMBODIMENTS

Embodiment 1

Figure 1:
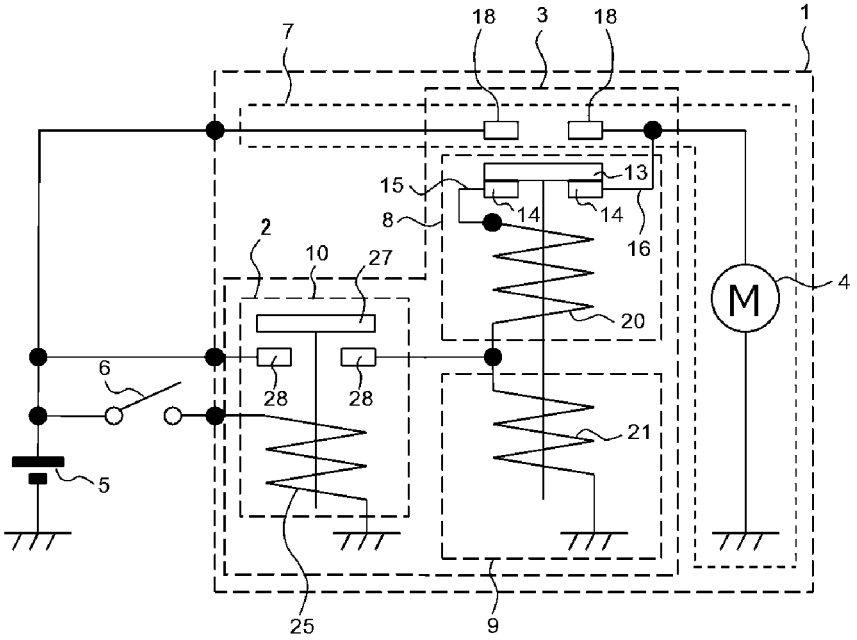
FIG. 1 is a circuit diagram of an internal combustion engine starting device equipped with an electromagnetic switch device for a starter according to Embodiment 1 of the present invention.
Figure 2:
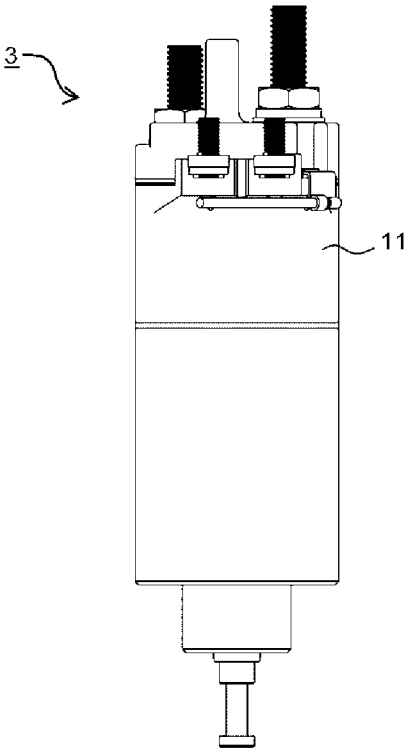
FIG. 2 is an external view of the electromagnetic switch device for a starter according to Embodiment 1 of the present invention.
Figure 3:
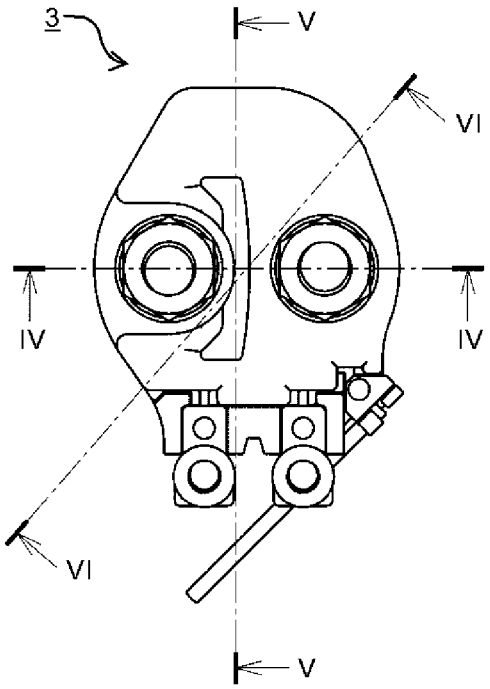
FIG. 3 is a top view of the electromagnetic switch device for a starter in FIG. 2 as seen from above.

In FIGS. 1 to 13, a starter 1 includes an auxiliary relay 2, an electromagnetic switch device 3 for a starter, and a motor 4. The starter 1 is a device that rotates an internal combustion engine which cannot start by itself.

The auxiliary relay 2 is a device that turns on/off operation of the electromagnetic switch device 3 for a starter.

The electromagnetic switch device 3 for a starter is a device that meshes a pinion of the starter 1 and a ring gear of the internal combustion engine with each other and that opens and closes a main electric circuit 7 for the motor 4. The motor 4 is a device that generates power for rotating the internal combustion engine.

The starter 1 operates by electric power from the battery 5. The operation thereof is controlled by a key switch 6.

An electric circuit of the starter 1 includes the main electric circuit 7 for the motor 4, a starting circuit 8, an attracting/holding circuit 9, and an auxiliary relay circuit 10, and a circuit obtained by removing the motor 4 of the main electric circuit 7 therefrom is formed as the electromagnetic switch device 3 for a starter.

Here, the main electric circuit 7 includes the motor 4 and main fixed contacts 18, the starting circuit 8 includes a main movable contact 13, starting circuit contacts 14, an A connector 15, a B connector 16, and a starting resistor 20, and the attracting/holding circuit 9 includes an attraction coil 21.

The A connector 15 connects the starting resistor 20 and one of a pair of the starting circuit contacts 14 to each other. The B connector 16 connects the other of the pair of the starting circuit contacts 14 and the main fixed contact 18, of a pair of the main fixed contacts 18, to which the motor 4 is connected, to each other.

Next, the configuration of the electromagnetic switch device 3 for a starter will be described.

A terminal block 11 of the electromagnetic switch device 3 for a starter is made of an insulating material, has a cylindrical shape a part of which protrudes in the radial direction, and has an opening portion in a protruding portion at one end in the axial direction of the cylindrical body thereof. The auxiliary relay 2 is provided in the opening portion. A contact chamber 11*a* is provided at the other end opposite to the one end.

The contact chamber 11*a* is: a space which is formed by a main fixed core 12 and an opening portion provided at the side opposite in the axial direction to the opening portion in which the auxiliary relay 2 is provided; a space in which the main movable contact 13 is moveable; and a space in which the pair of the starting circuit contacts 14, the A connector 15, the B connector 16, and an insulating member 17 are provided.

The pair of the main fixed contacts 18 are provided on a bottom portion of the contact chamber 11*a*, and the starting circuit contacts 14, the A connector 15, the B connector 16, and the insulating member 17 are provided at the opening side of the contact chamber 11*a*.

Figure 4:
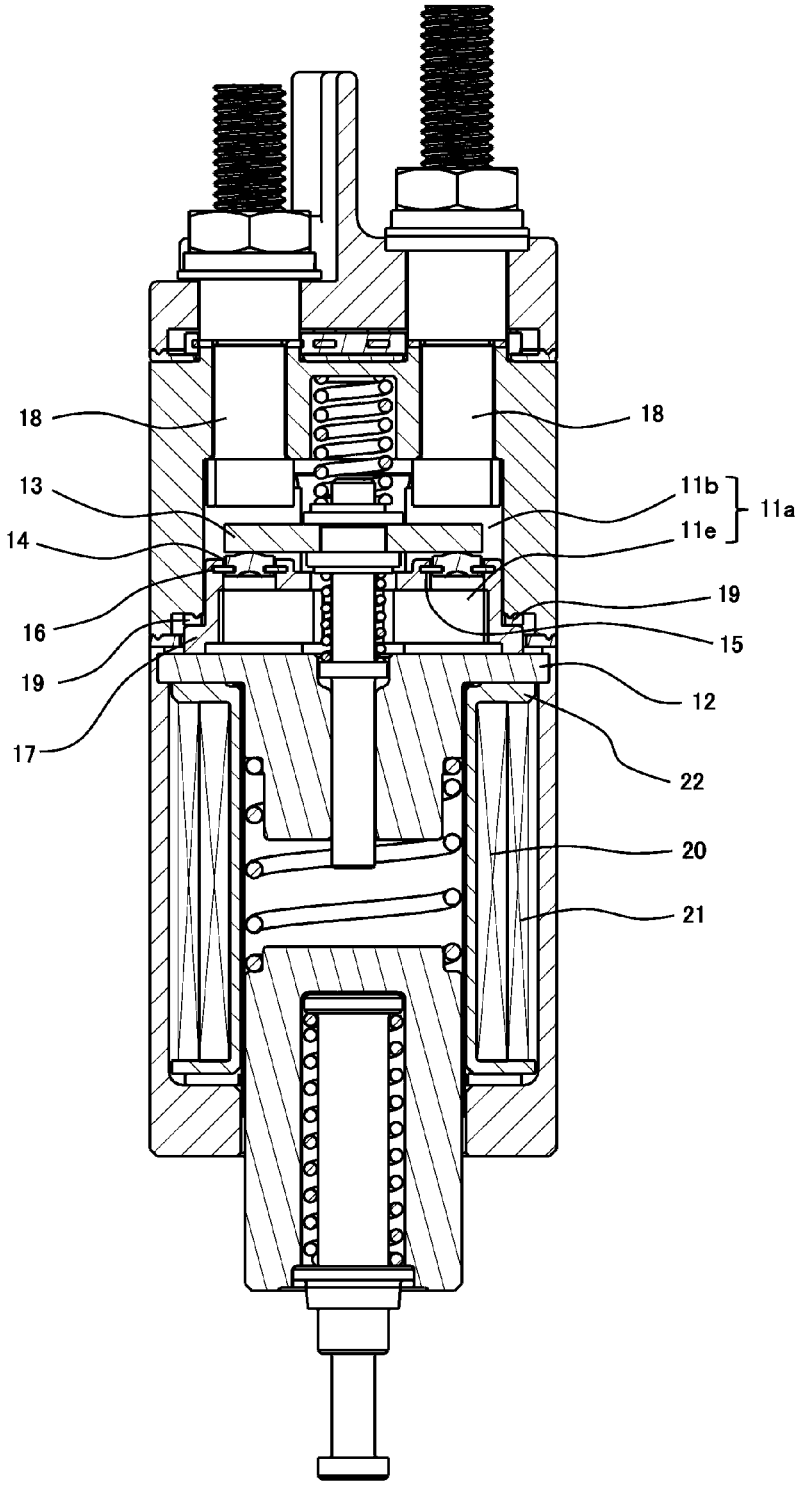
FIG. 4 is a cross-sectional view of the electromagnetic switch device for a starter taken along a line IV-IV in FIG. 2.

The contact chamber 11*a* is partitioned into a paired main fixed contact side 11*b* and a main fixed core side 11*c* by these components provided at the opening side (FIG. 4).

The insulating member 17 is made of an insulating material such as a synthetic resin and is integrally molded together with the A connector 15 and the B connector 16. The insulating member 17 is held between the terminal block 11 and the main fixed core 12. For the purpose of absorbing dimensional variations in manufacturing and for the purpose of sealing the contact chamber 11*a* in order to prevent entry of water into the contact chamber 11*a*, the insulating member 17 is pressingly held between the terminal block 11 and the main fixed core 12 with an elastic member 19, such as chloroprene rubber, interposed therebetween (FIG. 4).

Figure 7:
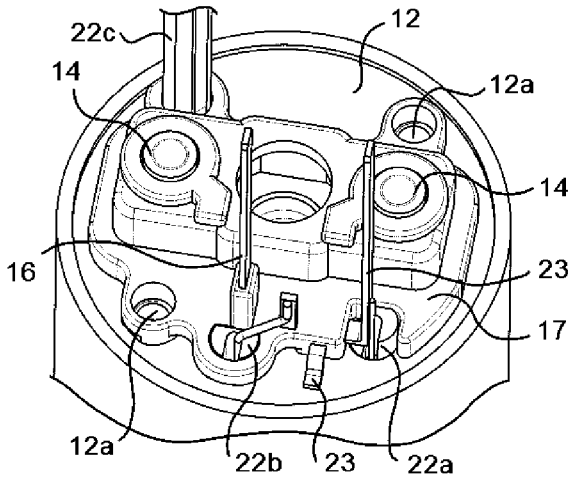
FIG. 7 is a perspective view showing connection states of an A connector and a B connector in the electromagnetic switch device for a starter according to Embodiment 1 of the present invention.

In addition, the insulating member 17 is positioned by lead-out portions 22*a*, 22*b*, and 22*c* of a main winding frame 22 on which the starting resistor 20 and the attraction coil 21 are wound (FIG. 7).

Figure 8:
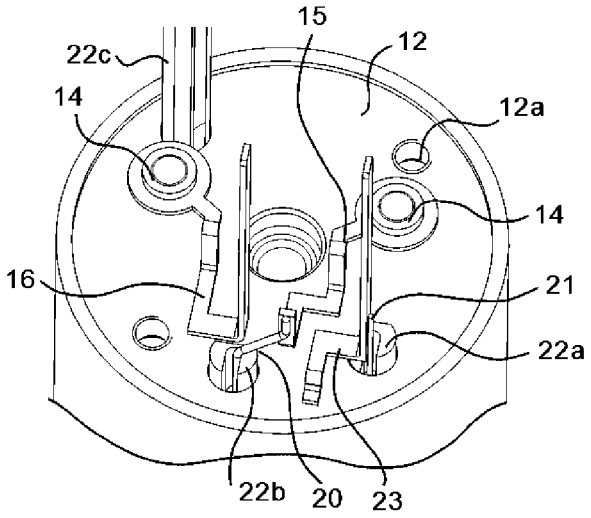
FIG. 8 is a perspective view in which an insulating member is removed from FIG. 7.

In this state, the A connector 15 and one end of the starting resistor 20, a lead-out connector 23 and the main fixed core 12, and the lead-out connector 23 and one end of the attraction coil 21 are welded (FIG. 8).

In the case where the starter 1 is of a ground floating type, the lead-out connector 23 and the main fixed core 12 are not welded, and are configured such that a required space distance and a required creepage distance are maintained.

In addition, the insulating member 17 is produced from a material and in a shape that allows the insulating member 17 to receive a load applied when the main movable contact 13 collides against the insulating member 17 and a load applied when the main movable contact 13 and the pair of the starting circuit contacts 14 are peeled from each other.

The elastic member 19 is produced from a material and in a shape that allows a contact surface pressure for preventing entry of water to be generated.

The insulating member 17 and the elastic member 19 may be an integrated component obtained by molding different materials in the same mold (so-called two-color molding).

Thus, the A connector 15 and the B connector 10 are not limited to those integrally molded with either the insulating member 17 or the elastic member 19, and may be molded between the insulating member 17 and the elastic member 19.

The main fixed core 12 is made of a magnetic material and forms a magnetic circuit that generates magnetic force by a magnetic field of the starting resistor 20 and the attraction coil 21. In addition, the main fixed core 12 is also a ground circuit for the attraction coil 21 and is electrically connected to the negative side of the battery 5.

Figure 6:
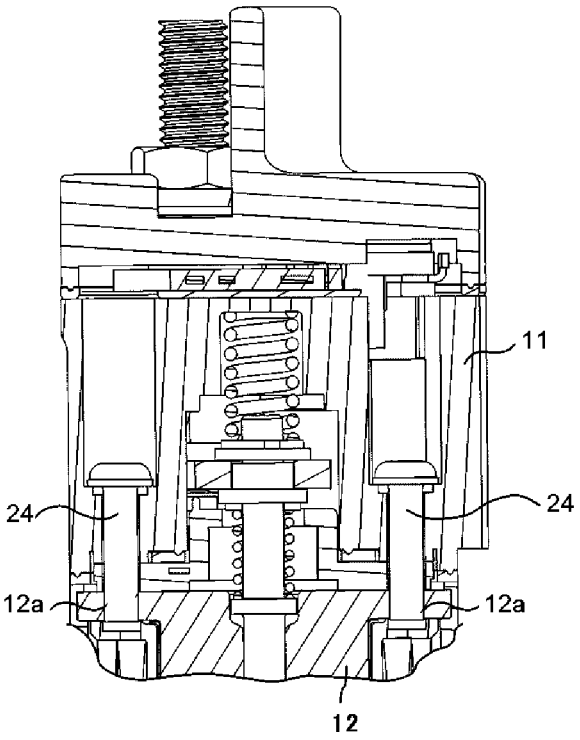
FIG. 6 is a cross-sectional view of a main part at and around the contact chamber taken along a line VI-VI in FIG. 2.

The main fixed core 12 is provided with female screws 12*a*, and the terminal block 11 is fixed thereto by using screws 24 (FIG. 6).

In the case where the starter 1 is of a ground floating type, the main fixed core 12 is not a ground circuit for the attraction coil 21, and is configured such that a required space distance and a required creepage distance are maintained with respect to the attraction coil 21.

As the pair of the starting circuit contacts 14, two components that are made of the same material and that have the same shape are used. The material of the starting circuit contacts 14 is a conductive material, and the shape thereof is a hollow rivet shape.

The starting circuit contacts 14 have head portions that are to be in contact with the main movable contact 13, and are hollow at the side opposite to the head portions. By plastically deforming the hollow portions, one of the starting circuit contacts 14 is fixed to the A connector 15, and the other of the starting circuit contacts 14 is fixed to the B connector 16 (FIGS. 7 and 8).

The A connector 15 is made of a conductive material and connects the starting resistor 20 and one of the pair of the starting circuit contacts 14 to each other.

The B connector 16 is made of a conductive material and connects the other of the pair of the starting circuit contacts 14 and the main fixed contact 18, of the pair of the main fixed contacts 18, to which the motor 4 is connected, to each other.

The lead-out connector 23 is made of a conductive material, is welded at one end thereof to the main fixed core 12, and is electrically joined at another end thereof to a sub coil 25, and the attraction coil 21 is welded and fixed to an intermediate portion of the lead-out connector 23 (FIGS. 7 and 8).

Due to such connection, one end of the attraction coil 21 and one end of the sub coil 25 are electrically connected to the negative side of the battery 5.

If possible, the attraction coil 21 may be welded directly to the main fixed core 12, or may be welded to the sub coil 25, and a configuration without using the lead-out connector 23 is also possible.

In addition, in the case where the starter 1 is of a ground floating type, the lead-out connector 23 and the main fixed core 12 are not welded to each other, and are configured such that a required space distance and a required creepage distance are maintained.

The starting resistor 20 is made of a conductive material. As for the starting resistor 20, a material is selected from among a steel material, a nonferrous metal material, an electric resistance material, and the like, and is wound on the main winding frame 22 by a required number of turns such that a required electric resistance value and required intensity of a magnetic field are achieved.

The starting resistor 20 is electrically connected at one end thereof to one of the paired sub fixed contacts 28 and is electrically connected at another end thereof to one of the pair of the starting circuit contacts 14.

The attraction coil 21 is made of a conductive material and is wound on the main winding frame 22. The attraction coil 21 is electrically connected at one end thereof to one of the paired sub fixed contacts 28 and is electrically connected at another end thereof to the negative side of the battery 5.

Figure 5:
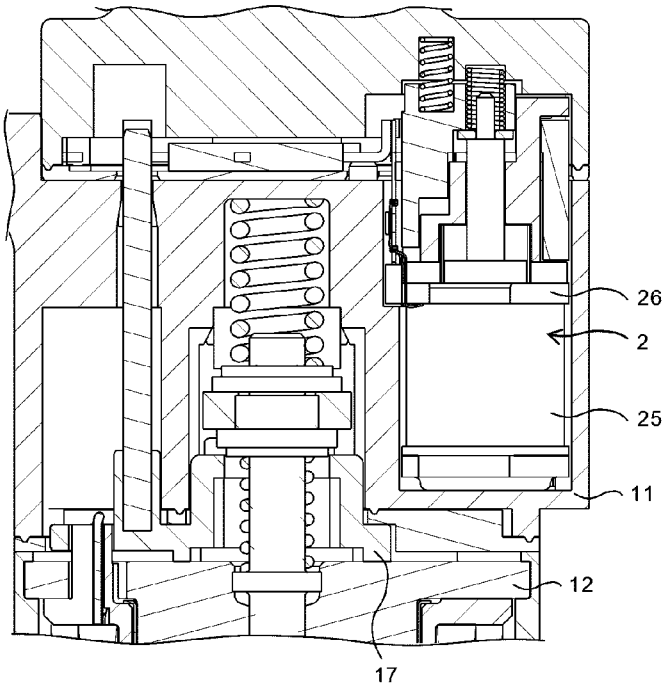
FIG. 5 is a cross-sectional view of a main part at and around a contact chamber taken along a line V-V in FIG. 2.

The sub coil 25 is made of a conductive material and is wound on a sub winding frame 26 (FIG. 5). The sub coil 25 is electrically connected at one end thereof to the key switch 6 and is electrically connected at another end thereof to the negative side of the battery 5.

Next, operation of the electromagnetic switch device 3 for a starter will be described.

In the starter 1, when the key switch 6 is turned on, a current flows through the sub coil 25 of the auxiliary relay 2, and a sub movable contact 27 moves toward the paired sub fixed contacts 28 by magnetic force of the sub coil 25, the paired sub fixed contacts 28 are short-circuited by the sub movable contact 27, and a current flows from the battery 5 through the starting circuit 8 and the attracting/holding circuit 9.

By magnetic force of the starting resistor 20 and the attraction coil 21, the main movable contact 13 starts to move toward the pair of the main fixed contacts 18.

At the same time, the pinion of the starter 1 starts motion of meshing with the ring gear of the internal combustion engine, and the motor 4 also gently starts to rotate by a current from the starting resistor 20.

After the main movable contact 13 starts to move, at around the time when the pinion of the starter 1 and the ring gear of the internal combustion engine complete the meshing motion, the pair of the starting circuit contacts 14 are opened.

As a result, no current flows through the starting circuit 8, but the main movable contact 13 continues to move by the magnetic force of the attraction coil 21.

Finally, the pair of the main fixed contacts 18 are short-circuited by the main movable contact 13, electric power from the battery 5 is supplied to the motor 4, and the motor 4 rotates at full power to rotate the internal combustion engine.

When the rotation of the motor 4 is stopped upon completion of start of the internal combustion engine or the like, the key switch 6 is turned off.

Accordingly, a current no longer flows through the sub coil 25, and thus the sub movable contact 27 moves in the direction away from the paired sub fixed contacts 28.

Then, the short circuit between the pared sub fixed contacts 28 is cancelled, so that a current no longer flows through the attraction coil 21. As a result, the main movable contact 13 moves in the direction away from the pair of the main fixed contacts 18, and the short circuit between the pair of the main fixed contacts 18 is cancelled, so that a current no longer flows through the motor 4.

In addition, when a current no longer flows through the attraction coil 21, the pinion of the starter 1 and the ring gear of the internal combustion engine that are in mesh with each other become disengaged from each other, so that each of the motor 4 and the pinion returns to a stationary state that is a state prior to operation.

The electromagnetic switch device for a starter according to Embodiment 1 of the present invention includes:

the pair of the main fixed contacts 18 forming the main electric circuit 7 for the motor 4;

the pair of the starting circuit contacts 14 forming the starting circuit 8 for the motor 4;

the main movable contact 13 which is movably located between the pair of the main fixed contacts 18 and the pair of the starting circuit contacts 14, which opens and closes the main electric circuit 7 for the motor 4 by opening and closing the pair of the main fixed contacts 18, and which opens and closes the starting circuit 8 for the motor 4 by opening and closing the pair of the starting circuit contacts 14;

the starting resistor 20 which forms the starting circuit 8 and through which a staring current for the motor 4 flows;

the attraction coil 21 generating a magnetic field for moving a main movable core toward the pair of the main fixed contacts;

the main fixed core 12 forming a magnetic circuit for generating magnetic force by the magnetic field of the attraction coil 21;

the terminal block 11 to which the main fixed contacts 18 are fixed and which includes the contact chamber 11*a* that is a space in which the main movable contact 13 is movable;

the A connector 15 which forms the starting circuit 8, which is connected to the starting resistor 20, and which has an end at which one of the pair of the starting circuit contacts 14 is located;

the B connector 16 which forms the starting circuit 8, which is connected to one of the pair of the main fixed contacts 18, and which has an end at which the other of the pair of the starting circuit contacts 14 is located;

the insulating member 17 electrically insulating the A connector 15 and the B connector 16 from the main fixed core 12; and the elastic member 19 sealing the contact chamber 11*a*, wherein the A connector 15 and the B connector 16 are held between the terminal block 11 and the main fixed core 12 with the insulating member 17 and the elastic member 19 interposed therebetween.

In the electromagnetic switch device 3 for a starter configured as described above, since the A connector 15 and the B connector 16 are pressingly held between the terminal block 11 and the main fixed core 12 with the insulating member 17 and the elastic member 19 interposed therebetween, it is not necessary to use conductive members such as screws in order to fix the pair of the starting circuit contacts 14.

In addition, the contact chamber 11*a* is partitioned into the main fixed contact side 11*b* and the main fixed core side 11*c* by the A connector 15, the B connector 16, the starting circuit contacts 14, and the insulating member 17. Accordingly, abrasion powder produced from the main movable contact 13, the pair of the main fixed contacts 18, and the pair of the starting circuit contacts 14 does not electrically contact with the main fixed core 12, which is a ground circuit.

Therefore, a leak path does not occur between the pair of the starting circuit contacts 14, the A connector 15, and the B connector 16, to which a voltage is applied at the time of operation of the electromagnetic switch device 3 for a starter and the main fixed core 12, which is a ground circuit, so that a leak current does not flow.

By integrally molding the insulating member 17, the A connector 15, the B connector 16, and the lead-out connector 23, it is possible to reduce the number of steps for assembling the electromagnetic switch device for a starter, so that it is possible to reduce the manufacturing cost.

By providing the auxiliary relay 2 in the terminal block 11, it is possible to reduce the size of the starter 1.

It is also possible to provide a wire for electrically connecting the auxiliary relay 2 and the electromagnetic switch device 3 for a starter to each other in the electromagnetic switch device 3 for a starter, and thus it is possible to reduce the size of the starter 1.

Embodiment 2

Next, the configuration of an electromagnetic switch device for a starter according to Embodiment 2 will be described.

Figure 9:
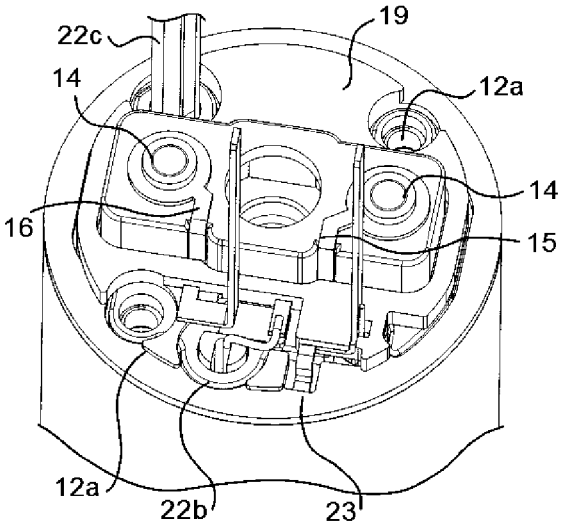
FIG. 9 is a perspective view showing connection states of an A connector and a B connector in an electromagnetic switch device for a starter according to Embodiment 2 of the present invention.
Figure 10:
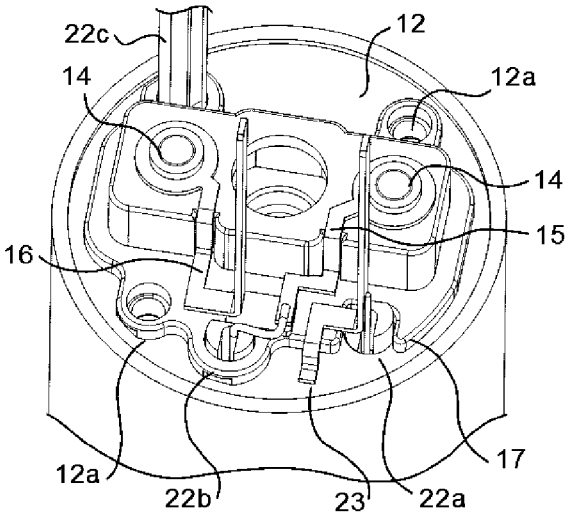
FIG. 10 is a perspective view in which an elastic member is removed from FIG. 9.

In Embodiment 2, as shown in FIGS. 9 and 10, the A connector 15, the B connector 16, and the lead-out connector 23, which are integrally molded together with the insulating member 17 in Embodiment 1, are configured to penetrate through the elastic member 19.

In the electromagnetic switch device 3 for a starter configured as described above, advantageous effects that are exactly the same as those in Embodiment 1 are obtained, but work for assembling the A connector 15, the B connector 16, and the lead-out connector 23 to the elastic member 19 is required in assembling the electromagnetic switch device for a starter.

Meanwhile, in the case of Embodiment 1, work for setting the A connector 15 and the B connector 16 within a mold for molding the insulating member 17 is required.

Which of Embodiments 1 and 2 is the best mode depends on conditions such as production quantity. Thus, options are increased by Embodiment 2, and it is possible to obtain the best mode.

Embodiment 3

Next, the configuration of an electromagnetic switch device for a starter according to Embodiment 3 will be described.

Figure 11:
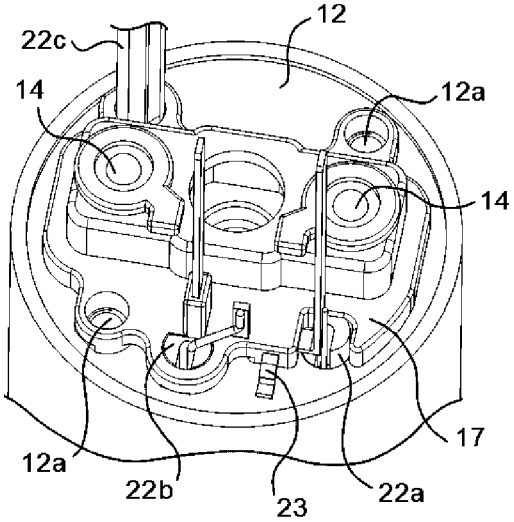
FIG. 11 is a perspective view showing connection states of an A connector and a B connector in an electromagnetic switch device for a starter according to Embodiment 3 of the present invention.
Figure 12:
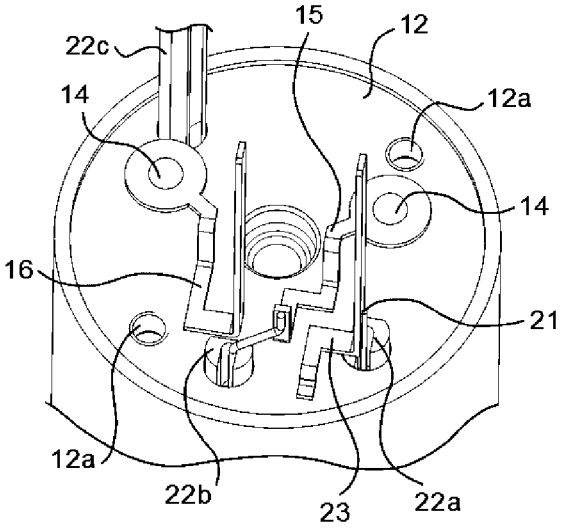
FIG. 12 is a perspective view in which an elastic member is removed from FIG. 11.
Figure 13:
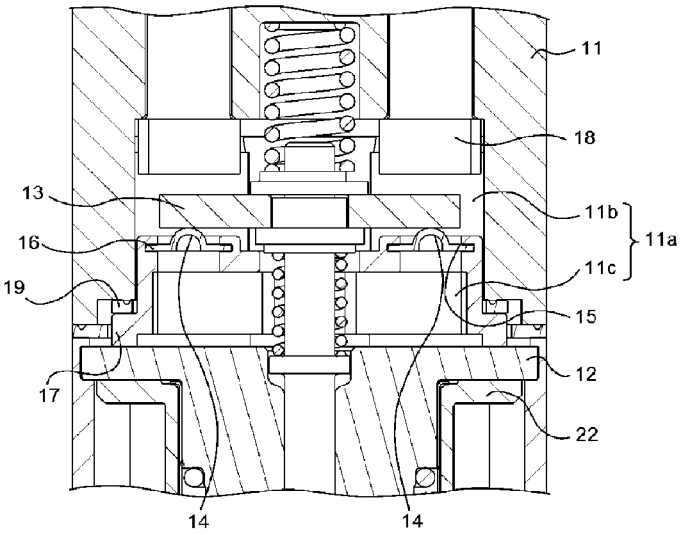
FIG. 13 is a cross-sectional view of a main part at and around a contact chamber in the electromagnetic switch device for a starter according to Embodiment 3 of the present invention.

In Embodiment 3, as shown in FIGS. 11 to 13, the pair of the starting circuit contacts 14, which are fixed to the A connector 15 and the B connector 16 in Embodiment 1, are formed from the same members as the A connector 15 and the B connector 16.

The shapes of the materials of the A connector 15 and the B connector 16 are sheet shapes, and the A connector 15 and the B connector 16 are produced by sheet metal processing such as bending and stamping.

The pair of the starting circuit contacts 14 are formed by a processing method such as drawing and bulging using the same sheet metal processing machine (progressive pressing machine) at the time of sheet metal processing.

Here, the sheet-shaped materials and sheet metal processing are used. However, any shape such as a rod material and a square material is selectable as the material shape, and any method such as forging is selectable as a processing method.

In the electromagnetic switch device 3 for a starter configured as described above, it is not necessary to produce the pair of the starting circuit contacts 14 in a different step, and work for fixing the pair of the starting circuit contacts 14 to the A connector 15 and the B connector 16 becomes unnecessary, so that it is possible to reduce the manufacturing cost.

The present invention is not limited to the embodiments, various design modifications can be made, and within the scope of the present invention, the embodiments may be freely combined with each other, or each embodiment may be modified or simplified as appropriate.

DESCRIPTION OF THE REFERENCE CHARACTERS

1 starter
2 auxiliary relay
3 electromagnetic switch device for a starter
4 motor
5 battery
6 key switch
7 main electric circuit
8 starting circuit
9 attracting/holding circuit
10 auxiliary relay circuit
11 terminal block
11*a* contact chamber
11*b* main fixed contact side
11*c* main fixed core side
12 main fixed core
12*a* female screw
13 main movable contact
14 a pair of starting circuit contacts
15 A connector
16 B connector
17 insulating member
18 a pair of main fixed contacts
19 elastic member
20 starting resistor
21 attraction coil
22 main winding frame
22*a*, 22*b*, 22*c* lead-out portion
23 lead-out connector
24 screw
25 sub coil
26 sub winding frame
27 sub movable contact
28 a pair of sub fixed contacts

The invention claimed is:

1. An electromagnetic switch device for a starter, comprising:

a pair of main fixed contacts forming a main electric circuit for a motor;

a pair of starting circuit contacts forming a starting circuit for the motor;

a main movable contact which is movably located between the pair of main fixed contacts and the pair of starting circuit contacts, which opens and closes the main electric circuit by opening and closing the pair of main fixed contacts, and which opens and closes the starting circuit by opening and closing the pair of starting circuit contacts;

a starting resistor which forms the starting circuit and through which a starting current for the motor flows;

an attraction coil generating a magnetic field for moving a main movable core toward the pair of main fixed contacts;

a main fixed core forming a magnetic circuit for generating magnetic force by the magnetic field of the attraction coil;

a terminal block to which the pair of main fixed contacts are fixed and which includes a contact chamber that is a space in which the main movable contact is movable;

an A connector which forms the starting circuit, which is connected to the starting resistor, and which has an end at which one of the pair of starting circuit contacts is located;

a B connector which forms the starting circuit, which is connected to one of the pair of main fixed contacts, and which has an end at which one of the pair of starting circuit contacts is located;

an insulating member electrically insulating the A connector and the B connector from the main fixed core; and an elastic member sealing the contact chamber, wherein the A connector and the B connector are held between the terminal block and the main fixed core with the insulating member and the elastic member interposed therebetween.

2. The electromagnetic switch device for a starter according to claim 1, wherein at least one of the A connector and the B connector is formed so as to be integrated with at least one of the insulating member and the elastic member.

3. The electromagnetic switch device for a starter according to claim 2, wherein at least one of the A connector and the B connector penetrates through the elastic member.

4. The electromagnetic switch device for a starter according to claim 3, wherein an auxiliary relay conducting and interrupting a current of the starting circuit and the attraction coil is provided in the terminal block.

5. The electromagnetic switch device for a starter according to claim 4, wherein one of the starting circuit contacts is formed from the same member as the A connector, and the other of the starting circuit contacts is formed from the same member as the B connector.

6. The electromagnetic switch device for a starter according to claim 3, wherein the contact chamber is partitioned into the main fixed contact side and the main fixed core side by the A connector, the B connector, the starting circuit contacts, and the insulating member.

7. The electromagnetic switch device for a starter according to claim 3, wherein one of the starting circuit contacts is formed from the same member as the A connector, and the other of the starting circuit contacts is formed from the same member as the B connector.

8. The electromagnetic switch device for a starter according to claim 2, wherein an auxiliary relay conducting and interrupting a current of the starting circuit and the attraction coil is provided in the terminal block.

9. The electromagnetic switch device for a starter according to claim 8, wherein one of the starting circuit contacts is formed from the same member as the A connector, and the other of the starting circuit contacts is formed from the same member as the B connector.

10. The electromagnetic switch device for a starter according to claim 2, wherein one of the starting circuit contacts is formed from the same member as the A connector, and the other of the starting circuit contacts is formed from the same member as the B connector.

11. The electromagnetic switch device for a starter according to claim 2, wherein the contact chamber is partitioned into the main fixed contact side and the main fixed core side by the A connector, the B connector, the starting circuit contacts, and the insulating member.

12. The electromagnetic switch device for a starter according to claim 1, wherein at least one of the A connector and the B connector penetrates through the elastic member.

13. The electromagnetic switch device for a starter according to claim 12, wherein an auxiliary relay conducting and interrupting a current of the starting circuit and the attraction coil is provided in the terminal block.

14. The electromagnetic switch device for a starter according to claim 13, wherein one of the starting circuit contacts is formed from the same member as the A connector, and the other of the starting circuit contacts is formed from the same member as the B connector.

15. The electromagnetic switch device for a starter according to claim 12, wherein one of the starting circuit contacts is formed from the same member as the A connector, and the other of the starting circuit contacts is formed from the same member as the B connector.

16. The electromagnetic switch device for a starter according to claim 12, wherein the contact chamber is partitioned into the main fixed contact side and the main fixed core side by the A connector, the B connector, the starting circuit contacts, and the insulating member.

17. The electromagnetic switch device for a starter according to claim 1, wherein an auxiliary relay conducting and interrupting a current of the starting circuit and the attraction coil is provided in the terminal block.

18. The electromagnetic switch device for a starter according to claim 17, wherein one of the starting circuit contacts is formed from the same member as the A connector, and the other of the starting circuit contacts is formed from the same member as the B connector.

19. The electromagnetic switch device for a starter according to claim 1, wherein one of the starting circuit contacts is formed from the same member as the A connector, and the other of the starting circuit contacts is formed from the same member as the B connector.

20. The electromagnetic switch device for a starter according to claim 1, wherein the contact chamber is partitioned into the main fixed contact side and the main fixed core side by the A connector, the B connector, the starting circuit contacts, and the insulating member.

* * * * *